US007153141B1

(12) United States Patent
Liu

(10) Patent No.: US 7,153,141 B1
(45) Date of Patent: Dec. 26, 2006

(54) CONNECTOR OF ELECTRONIC DEVICE

(75) Inventor: Chia-Fu Liu, Taoyuan Hsien (TW)

(73) Assignee: Delta Electronics, Inc. (TW)

( * ) Notice: Subject to any disclaimer, the term of this patent is extended or adjusted under 35 U.S.C. 154(b) by 0 days.

(21) Appl. No.: 11/335,724

(22) Filed: Jan. 19, 2006

(30) Foreign Application Priority Data

Jun. 8, 2005 (TW) ..... 94118945 A

(51) Int. Cl.
*H01R 24/04* (2006.01)

(52) U.S. Cl. ..... 434/668

(58) Field of Classification Search ..... 439/668, 439/669, 578, 891, 98, 99
See application file for complete search history.

(56) References Cited

U.S. PATENT DOCUMENTS 5,498,838 A * 3/1996 Furman ..... 174/74 R

* cited by examiner

*Primary Examiner*—Ross Gushi

(57) ABSTRACT

A connector includes a main body, a conducting member and an auxiliary member. The main body has a first connecting part. The conducting member is sheathed around the first connecting part and has a first engaging element. A first end of the auxiliary member is electrically connected to a first wire of an electric cable. A second end of the auxiliary member has a second engaging element engaged with the first engaging element of the conducting member and electrically connected to the first connecting part of the main body.

14 Claims, 7 Drawing Sheets

CONNECTOR OF ELECTRONIC DEVICE

FIELD OF THE INVENTION

The present invention relates to a connector, and more particularly to a connector of an electronic device.

BACKGROUND OF THE INVENTION

A power supply apparatus such as an adapter is widely used for rectifying and converting AC power into DC power. The circuitry mounted on a circuit board of the adapter converts commercial AC power into DC power, and the converted DC power is supplied to electric appliance such as notebooks, mobile phones, printers, etc.

Referring to FIG. 1(*a*), a conventional adapter for supplying power to a notebook is illustrated. One end of the adapter 11 is connected to an AC plug 13 via a power cord 12. The other end of the adapter 11 is connected to a connector 15 via a DC cable 14. After the connector 15 is plugged into a power socket 161 of the notebook 16, the AC power is received from the AC plug 13 to the adapter 11 and converted into DC power. The DC power is transferred to the notebook via the DC cable 14 and the connector 15.

Please refer to FIG. 1(*a*) again. The junction of the DC cable 14 and the connector 15 is covered with a plastic casing 17. For purposes of clarity, as shown in FIG. 1(*b*), the plastic casing 17 is removed in order to exhibit internal electrical connection between the DC cable 14 and the connector 15. The DC cable 14 includes a positive wire 141 and a negative wire 142. The connector 15 includes a negative connecting part 151 and a positive connecting part 152. The positive wire 141 of the DC cable 14 is bonded to the positive connecting part 152 of the connector 15 via a soldering material 18 so as to make electrical connection between the positive wire 141 of the DC cable 14 and the positive connecting part 152 of the connector 15. The negative wire 142 of the DC cable 14 strides over the positive wire 141 and an insulating element 19 and the negative wire 142 of the DC cable 14 is then bonded to the negative connecting part 151 of the connector 15 via the soldering material 18 by a lap welding technology, thereby making electrical connection between the negative wire 142 of the DC cable 14 and the negative connecting part 151 of the connector 15.

As known, when the notebook 16 is not in use and the adapter 11 needs to be stored, the connector 15 would be pulled out of the power socket 161 of the notebook 16 (as shown in FIG. 1(*a*)). During the process of pulling out the connector 15, an external force is applied onto the plastic casing 17 and the negative wire 142 of the DC cable 14 is readily separated from the negative connecting part 151 of the connector 15 due to the weak attachment of the soldering material 18. Under this circumstance, the adapter 11 has a breakdown because the electrical connection between the negative wire 142 and the negative connecting part 151 is lost.

Referring in FIG. 1(*c*), another internal connection mechanism between the DC cable 14 and the connector 15 is illustrated. A conductive ring structure 153 is arranged between the insulating element 19 and the negative connecting part 151 of the connector 15. The conductive ring structure 153 has a protrusion part 1531, which has a perforation 1532 at the tip portion. Likewise, the positive wire 141 of the DC cable 14 is bonded to the positive connecting part 152 of the connector 15 via a soldering material 18 so as to make electrical connection between the positive wire 141 of the DC cable 14 and the positive connecting part 152 of the connector 15. Whereas, in order to make electrical connection between the negative wire 142 of the DC cable 14 and the negative connecting part 151 of the connector 15, the negative wire 142 firstly penetrates through the perforation 1532 and the negative wire 142 is then bonded to the protrusion part 1531 of the conductive ring structure 153 in the vicinity of the perforation 1532 via the soldering material 18. Afterward, the conductive ring structure 153 is bent down toward the insulating element 19 such that the protrusion part 1531 of the conductive ring structure 153 is substantially parallel to the insulating element 19, as can be seen in FIG. 1(*d*).

In view of the attachment between the negative wire 142 and the negative connecting part 151, the internal connection mechanism of FIG. 1(*d*) is better than that of FIG. 1(*b*). The problem of detachment during the process of pulling out the connector 15 still exists. The reason of detachment may also be contributed to the weak attachment of the soldering material 18 and the welding technology. Furthermore, this welding method is time-consuming and labor-intensive.

In views of the above-described disadvantages resulted from the conventional method, the applicant keeps on carving unflaggingly to develop a connector of an electronic device according to the present invention through wholehearted experience and research.

SUMMARY OF THE INVENTION

It is an object of the present invention to provide a connector coupled to a DC cable in a mechanically engaged manner.

It is another object of the present invention to provide a connector securely attached to a DC cable.

In accordance with a first aspect of the present invention, there is provided a connector of an electronic device. The connector comprises a main body, a conducting member and an auxiliary member. The main body has a first connecting part. The conducting member is sheathed around the first connecting part and has a first engaging element. A first end of the auxiliary member is electrically connected to a first wire of an electric cable. A second end of the auxiliary member has a second engaging element engaged with the first engaging element of the conducting member and electrically connected to the first connecting part of the main body.

Preferably, the electronic device is an adapter.

Preferably, the electric cable is a DC cable.

In an embodiment, the first wire and the first connecting part are a negative wire and a negative connecting part, respectively.

In an embodiment, the main body further comprises a second connecting part boned to a second wire of the electric cable via a soldering material.

In an embodiment, the main body further comprises an insulating element between the first connecting part and the second connecting part for electrically isolating the first connecting part from the second connecting part.

In an embodiment, the second wire and the second connecting part are a positive wire and a positive connecting part, respectively.

In an embodiment, the second engaging element of the auxiliary member is a tilted piece.

In an embodiment, the first engaging element of the conducting member includes an indentation structure to be engaged with the tilted piece, thereby facilitating secure attachment and electrical connection between the first wire of the electric cable and the first connecting part of the main body.

Alternatively, the first engaging element of the conducting member includes a slot structure to be engaged with the tilted piece, thereby facilitating secure attachment and electrical connection between the first wire of the electric cable and the first connecting part of the main body.

In an embodiment, the conducting member further comprises a bent piece in the vicinity of the slot structure and sustained against the tilted piece.

In an embodiment, the conducting member further comprises a neck structure sustained against the auxiliary member for offering more secure attachment of the conducting member and the auxiliary member.

In an embodiment, a junction between the first engaging element of the conducting member and the second engaging element of the auxiliary member is soldered via a soldering material.

In an embodiment, the auxiliary member further comprises two extension arms defining a guiding channel therebetween for accommodating the conducting member therein.

The above contents of the present invention will become more readily apparent to those ordinarily skilled in the art after reviewing the following detailed description and accompanying drawings, in which:

BRIEF DESCRIPTION OF THE DRAWINGS

FIG. 1(*b*) schematically illustrates an approach for making electrical connection between the DC cable and the connector according to prior art;

FIGS. 1(*c*) and 1(*d*) schematically illustrate another approach for making electrical connection between the DC cable and the connector according to prior art;

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1A:
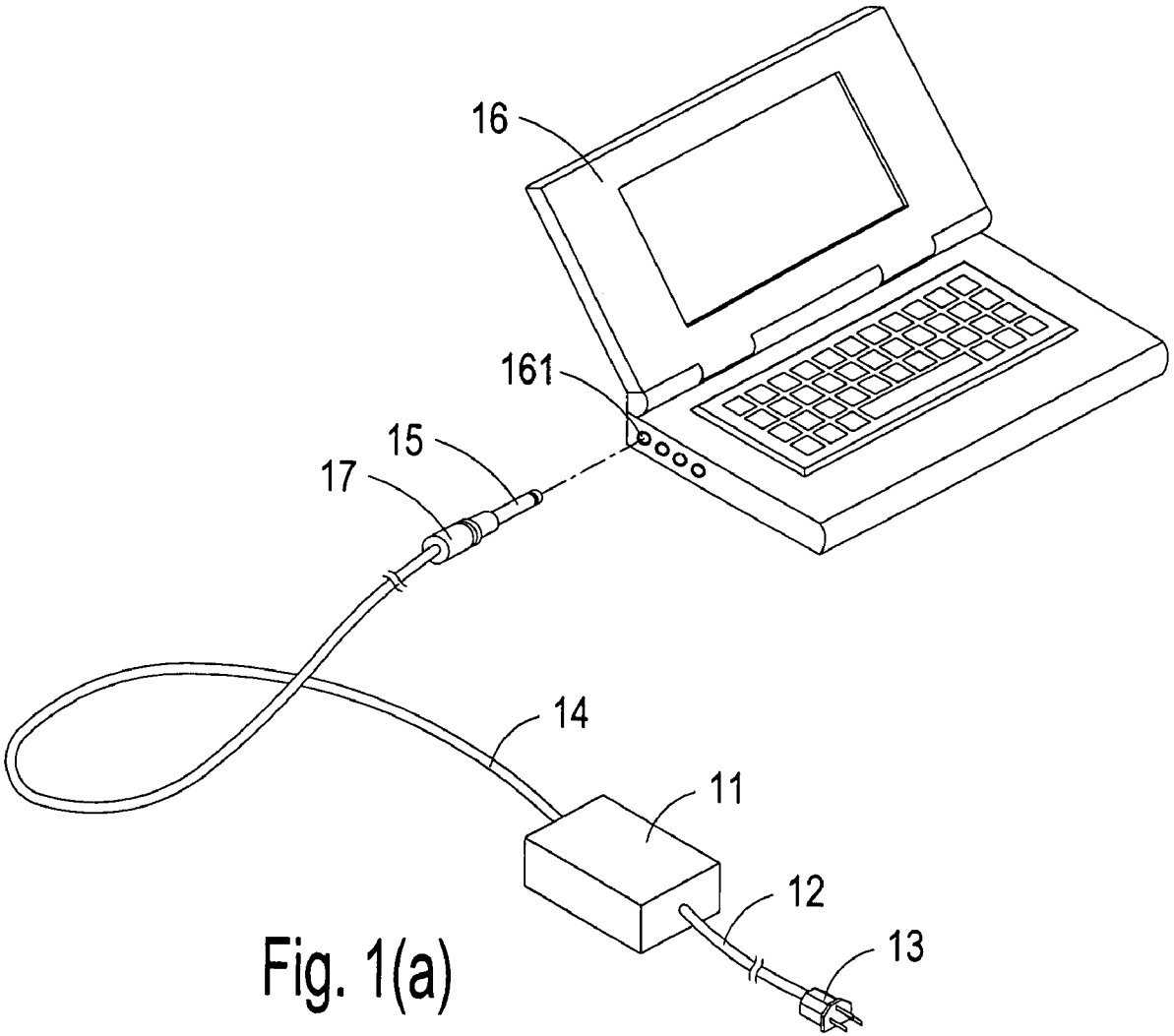
Fig. 1(a) PRIOR ART
FIG. 1(*a*) schematically illustrates a conventional adapter for supplying DC power to a notebook.
Figure 1B:
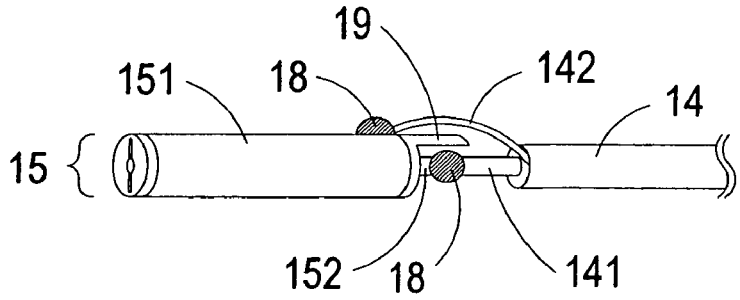
Fig. 1(b) PRIOR ART
Figure 1C:
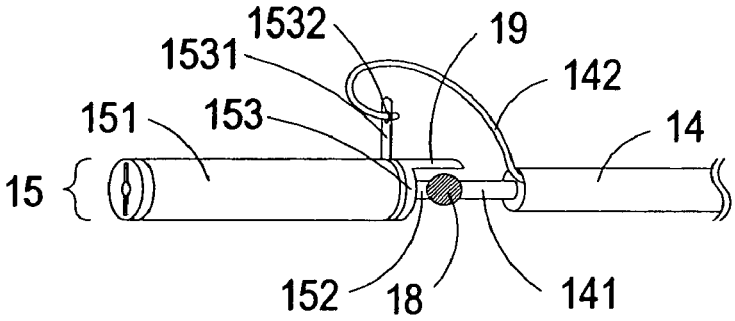
Fig. 1(c) PRIOR ART
Figure 1D:
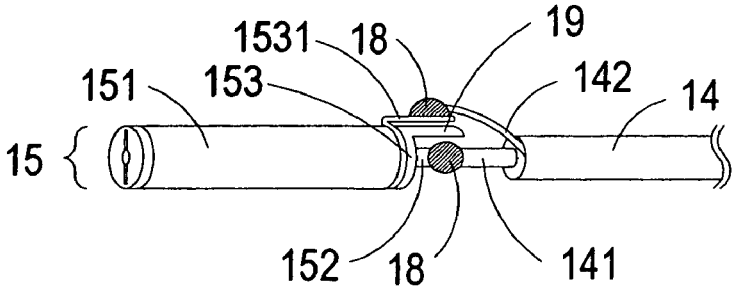
Fig. 1(d) PRIOR ART
Figure 2A:
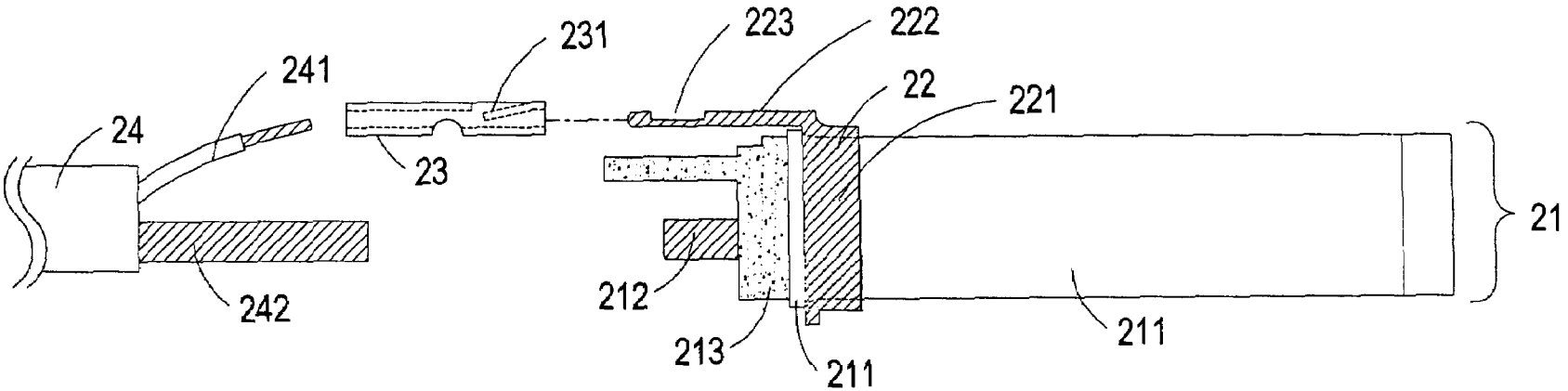
FIGS. 2(*a*) and 2(*b*) are schematic cross-sectional views illustrating an approach for making electrical connection between the DC cable and the connector according to a preferred embodiment of the present invention.
Figure 2B:
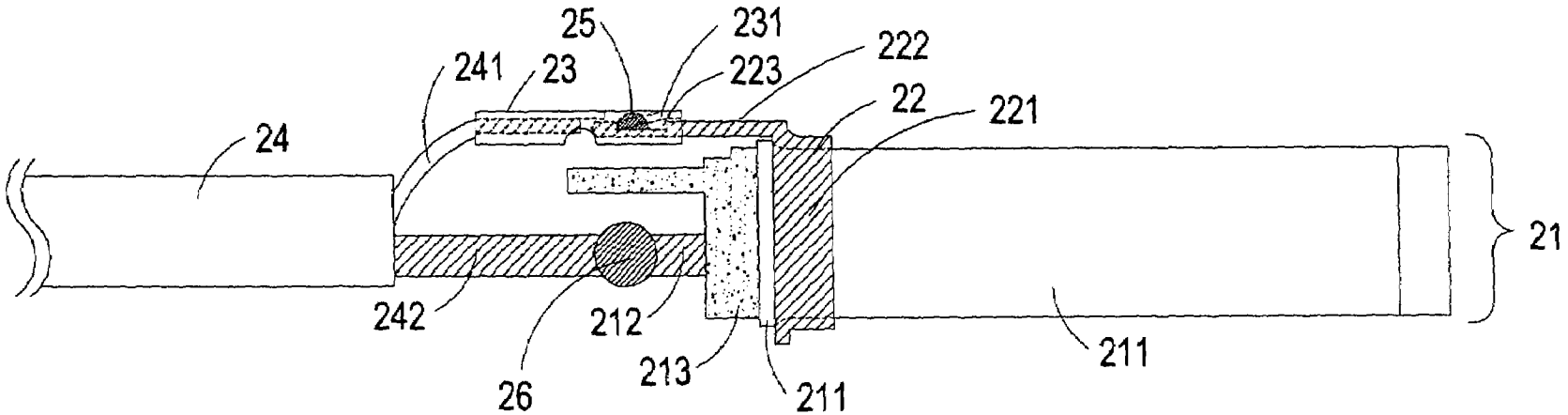

FIGS. 2(*a*) and 2(*b*) are schematic cross-sectional views illustrating an approach for making electrical connection between the DC cable and the connector according to a preferred embodiment of the present invention. The connector is applicable to an electronic device such as an adapter. In FIG. 2(*a*), the connector comprises a main body 21, a conducting member 22 and an auxiliary member 23. The connector is coupled to a DC cable 24 in a mechanically engaged manner. The DC cable 24 comprises a negative wire 241 and a positive wire 242.

The main body 21 comprises a negative connecting part 211, a positive connecting part 212 and an insulating element 213. The negative connecting part 211 is disposed on most external surface of the main body 21, and is made of an electrically conductive material such as iron. The positive connecting part 212 is also made of an electrically conductive material. The insulating element 213 is arranged between the negative connecting part 211 and the positive connecting part 212 and made of a plastic material. The insulating element 213 is helpful for electrically isolating the negative connecting part 211 from the positive connecting part 212.

The conducting member 22 includes a ring structure 221 and a protrusion plate 222 protruded from an edge of the ring structure 221. The ring structure 221 is sheathed around a portion of the periphery of the negative connecting part 211 and electrically connected to the negative connecting part 211. In addition, the conducting member 22 further comprises a first engaging element 223 such as an indentation structure in the protrusion plate 222.

The auxiliary member 23 is substantially a hollow tube and made of an electrically conductive material. A first end of the auxiliary member 23 is connected to the negative wire 241 of the DC cable 24 by embedding the negative wire 241 into the hollow tube, as shown in FIG. 2(*b*). A second end of the auxiliary member 23 includes a second engaging element 231 matching with the first engaging element 223 of the conducting member 22. In a case that the first engaging element 223 is an indentation structure, an example of the second engaging element 231 is a tilted piece. Once the protrusion plate 222 of the conducting member 22 is inserted into the second end of the auxiliary member 23 to a certain distance, the tilted piece 231 is engaged with the indentation structure 223. The engagement of the tilted piece 231 and the indentation structure 223 facilitates secure attachment of the conducting member 22 and the auxiliary member 23. Under this circumstance, the negative connecting part 211 is electrically connected to the negative wire 241 of the DC cable 24.

Alternatively, in order to further enhance the attachment of the conducting member 22 and the auxiliary member 23, after the tilted piece 231 is engaged with the indentation structure 223, the junction between the tilted piece 231 and the indentation structure 223 is soldered via a soldering material 25.

The positive connecting part 212 is disposed at the front end of the of the main body 21 corresponding to the positive wire 242 of the DC cable 24. After the tilted piece 231 and the indentation structure 223 are bonded together, the positive wire 242 of the DC cable 24 is bonded to the positive connecting part 212 via a soldering material 26, thereby making electrical connection between the positive wire 242 and the positive connecting part 212.

Figure 3A:
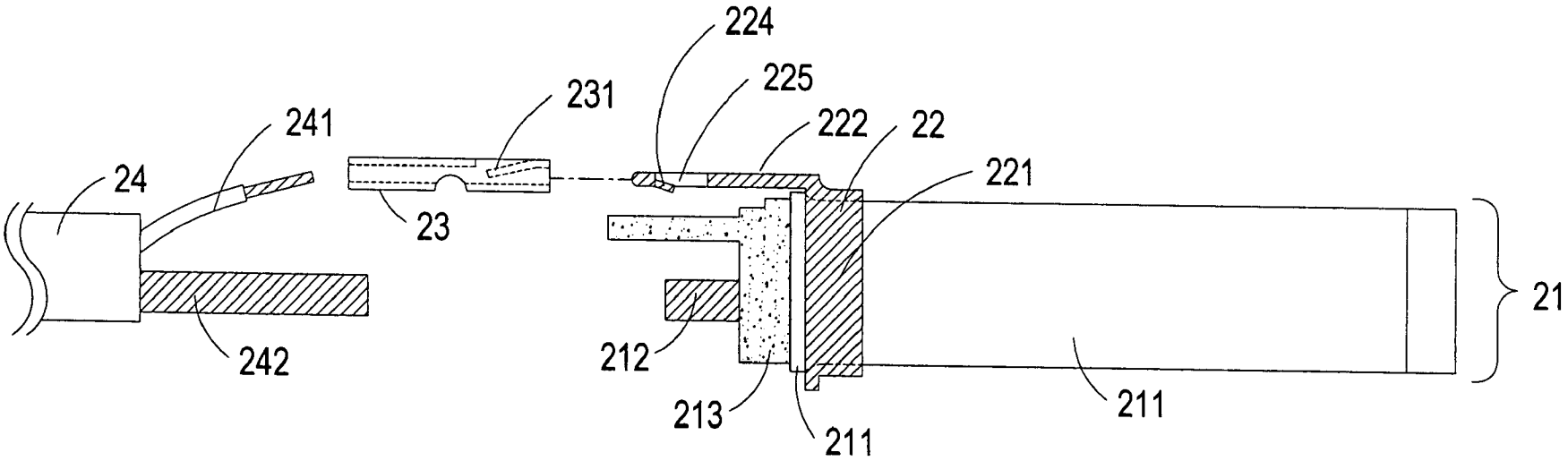
FIGS. 3(*a*) and 3(*b*) are schematic cross-sectional views illustrating an approach for making electrical connection between the DC cable and the connector according to another preferred embodiment of the present invention.
Figure 3B:
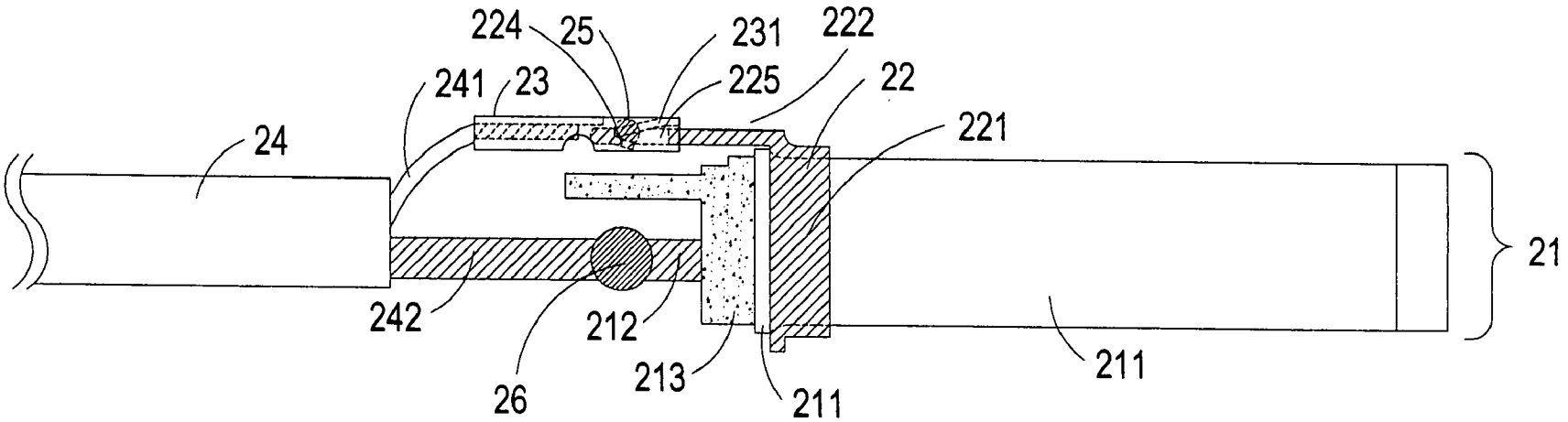

A further embodiment of an approach for making electrical connection between the DC cable and the connector are illustrated in FIGS. 3(*a*) and 3(*b*). The connector of FIG. 3(*a*) comprises a main body 21, a conducting member 22 and an auxiliary member 23. In this embodiment, the main body 21 and the auxiliary member 23 included therein are similar to those shown in FIG. 2, and are not to be redundantly described herein.

Likewise, the conducting member 22 also includes a ring structure 221 and a protrusion plate 222 protruded from an edge of the ring structure 221. The ring structure 221 is sheathed around a portion of the periphery of the negative connecting part 211 and electrically connected to the negative connecting part 211. Whereas, a bent piece 224 is formed at the tip portion of the protrusion plate 222, and a slot structure 225 is formed in the protrusion plate 222 and adjacent to the bent piece 224. The slot structure 225 has a function similar to the first engaging element 223, as is described in the first embodiment. As shown in FIG. 3(*b*), once the protrusion plate 222 of the conducting member 22 is inserted into the second end of the auxiliary member 23 to a certain distance, the tilted piece 231 is engaged with the slot structure 225. The engagement of the tilted piece 231 and the slot structure 225 facilitates secure attachment of the conducting member 22 and the auxiliary member 23. Under this circumstance, the negative connecting part 211 is electrically connected to the negative wire 241 of the DC cable 24. In addition, since the bent piece 224 is sustained against the tilted piece 213, the attachment of the conducting member 22 and the auxiliary member 23 is enhanced.

Alternatively, in order to further enhance the attachment of the conducting member 22 and the auxiliary member 23, after the tilted piece 231 is engaged with the slot structure 225, the junction between the tilted piece 231 and the slot structure 225 is soldered via a soldering material 25.

In addition, after the tilted piece 231 and the slot structure 225 are bonded together, the positive wire 242 of the DC cable 24 is bonded to the positive connecting part 212 via a soldering material 26, thereby making electrical connection between the positive wire 242 and the positive connecting part 212.

Figure 4:
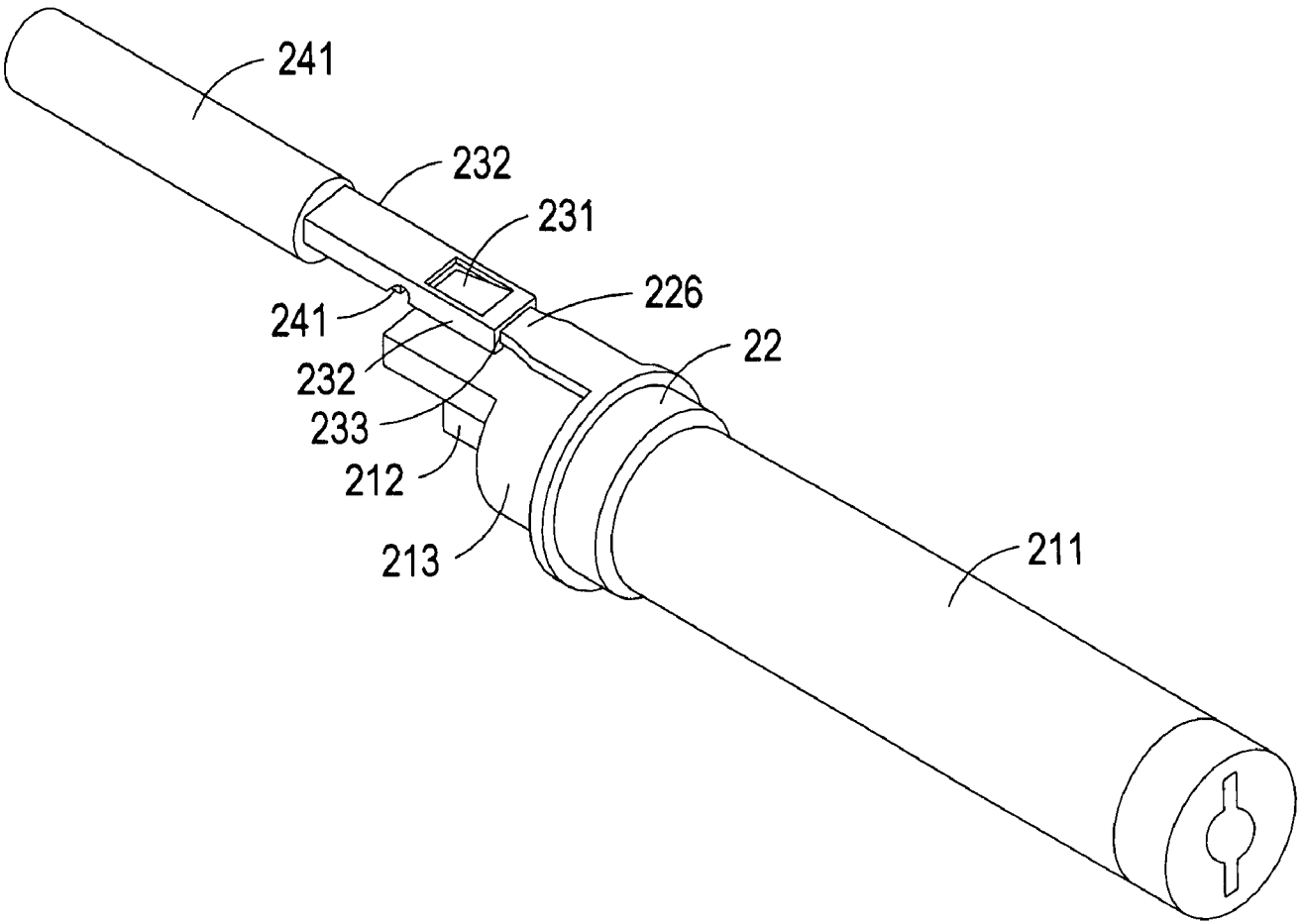
FIG. 4 is a perspective view illustrating the combination of the connector and the DC cable as shown in FIG. 2(*b*) or FIG. 3(*b*).

Please refer to FIG. 4, which is a perspective view illustrating the combination of the connector and the DC cable as shown in FIG. 2(*b*) or FIG. 3(*b*). The conducting member 22 further comprises a neck structure 226 adjacent to the first engaging element, i.e. the indentation structure 223 or the slot structure 225. The neck structure 226 is helpful for offering more secure attachment of the conducting member 22 and the auxiliary member 23. The auxiliary member 23 further comprises two extension arms 232 at opposite sides of the tilted piece 231 and defined as a guiding channel 233 therebetween. The width of the guiding channel 233 is sufficient for embedding the tip portion of the protrusion plate 222 therein. By the way, after the connector is coupled to the DC cable, the junction of the DC cable and the connector needs to be covered with a plastic casing (not shown) to provide isolation.

It is noted that, however, those skilled in the art will readily observe that numerous modifications and alterations of the first and second engaging elements may be made while retaining the teachings of the invention. For example, the first engaging element may be a protrusion structure, and the second engaging element may be another protrusion structure or slot structure matching with the first engaging element. Accordingly, the above disclosure should be limited only by the bounds of the following claims.

From the above description, the connector of the present invention is coupled to a DC cable in a mechanically engaged manner. The engagement of the first and second engaging elements makes electrical connection between the negative connecting part of the connector and the negative wire of the DC cable and facilitates secure attachment of the conducting member and the auxiliary member.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A connector of an electronic device, comprising:

a main body having a first connecting part;

a conducting member sheathed around said first connecting part and having a first engaging element; and an auxiliary member comprising a first end electrically connected to a first wire of an electric cable and a second end having a second engaging element engaged with said first engaging element of said conducting member and electrically connected to said first connecting part of said main body;

wherein said main body further comprises a second connecting part bonded to a second wire of said electric cable.

2. The connector according to claim 1 wherein said electronic device is an adapter.

3. The connector according to claim 1 wherein said electric cable is a DC cable.

4. The connector according to claim 1 wherein said first wire and said first connecting part are a negative wire and a negative connecting part, respectively.

5. The connector according to claim 1 wherein said conducting member further comprises a neck structure sustained against said auxiliary member for offering more secure attachment of said conducting member and said auxiliary member.

6. The connector according to claim 1 wherein a junction between said first engaging element of said conducting member and said second engaging element of said auxiliary member is soldered via a soldering material.

7. The connector according to claim 1 wherein said auxiliary member further comprises two extension arms defining a guiding channel therebetween for accommodating said conducting member therein.

8. The connector according to claim 1 wherein said second connecting part is bonded to said second wire of said electric cable via a soldering material.

9. The connector according to claim 1 wherein said main body further comprises an insulating element between said first connecting part and said second connecting part for electrically isolating said first connecting part from said second connecting part.

10. The connector according to claim 1 wherein said second wire and said second connecting part are a positive wire and a positive connecting part, respectively.

11. The connector according to claim 1 wherein said second engaging element of said auxiliary member is a tilted piece.

12. The connector according to claim 11 wherein said first engaging element of said conducting member includes an indentation structure to be engaged with said tilted piece, thereby facilitating secure attachment and electrical connection between said first wire of said electric cable and said first connecting part of said main body.

13. The connector according to claim 11 wherein said first engaging element of said conducting member includes a slot structure to be engaged with said tilted piece, thereby facilitating secure attachment and electrical connection between said first wire of said electric cable and said first connecting part of said main body.

14. The connector according to claim 13 wherein said conducting member further comprises a bent piece in the vicinity of said slot structure and sustained against said tilted piece.

* * * * *